US006897809B2

(12) United States Patent
Carson et al.

(10) Patent No.: US 6,897,809 B2
(45) Date of Patent: May 24, 2005

(54) APERTURE COUPLED CAVITY BACKED PATCH ANTENNA

(75) Inventors: James C. Carson, Sugar Hill, GA (US); James K. Tillery, Woodstock, GA (US); Sara Phillips, Norcross, GA (US)

(73) Assignee: EMS Technologies, Inc., Norcross, GA (US)

( * ) Notice: Subject to any disclaimer, the term of this patent is extended or adjusted under 35 U.S.C. 154(b) by 171 days.

(21) Appl. No.: 10/091,186

(22) Filed: Mar. 4, 2002

(65) Prior Publication Data

US 2002/0180644 A1 Dec. 5, 2002

Related U.S. Application Data

(63) Continuation of application No. 09/785,032, filed on Feb. 16, 2001, now Pat. No. 6,392,600.

(51) Int. Cl.[7] ..... H01Q 1/38
(52) U.S. Cl. ..... 343/700 MS; 343/846
(58) Field of Search ..... 343/700 MS, 846, 343/702, 767, 770, 848, 872

(56) References Cited

U.S. PATENT DOCUMENTS

| | | | | | |
|---|---|---|---|---|---|
| 4,816,835 | A | * | 3/1989 | Abiko et al. | 343/700 MS |
| 4,851,855 | A | | 7/1989 | Tsukamoto et al. | 343/700 MS |
| 4,903,033 | A | | 2/1990 | Tsao et al. | 343/700 MS |
| 5,581,266 | A | | 12/1996 | Peng et al. | 343/770 |
| 5,828,339 | A | | 10/1998 | Patel | 343/700 MS |
| 5,874,919 | A | * | 2/1999 | Rawnick et al. | 343/700 MS |
| 6,008,763 | A | | 12/1999 | Nystrom et al. | 343/700 MS |
| 6,067,053 | A | | 5/2000 | Runyon et al. | 343/797 |
| 6,087,989 | A | | 7/2000 | Song et al. | 343/700 MS |
| 6,144,344 | A | * | 11/2000 | Kim et al. | 343/770 |
| 6,236,367 | B1 | | 5/2001 | Du Toit et al. | 343/700 MS |
| 6,239,750 | B1 | | 5/2001 | Snygg | 343/700 MS |
| 6,239,762 | B1 | | 5/2001 | Lier | 343/770 |

FOREIGN PATENT DOCUMENTS

| | | |
|---|---|---|
| EP | 0 892 461 A1 | 1/1999 |
| EP | 0 901 185 A1 | 3/1999 |

* cited by examiner

*Primary Examiner*—Tan Ho
(74) *Attorney, Agent, or Firm*—King & Spalding LLP

(57) ABSTRACT

A compact antenna system can generate RF radiation fields having increased beamwidths and bandwidths. The antenna system can include one or more patch radiators. The lower patch radiators can be mounted to a printed circuit board that can include a ground plane which defines a plurality of slots. The slots within the ground plane of the printed circuit board can be excited by stubs that are part of the feed network of the printed circuit board. The slots, in turn, can establish RF radiation in a cavity which is disposed adjacent to the ground plane of the printed circuit board and a ground plane of the antenna system.

17 Claims, 10 Drawing Sheets

APERTURE COUPLED CAVITY BACKED PATCH ANTENNA

CROSS REFERENCE TO RELATED APPLICATION

This application is a continuation of U.S. application Ser. No. 09/785,032, filed Feb. 16, 2001, now U.S. Pat. No. 6,392,600, entitled, "Method and Shystem for Increasing RF Bandwidth and Beamwidth in a Compact Volume", the entire contents of which are hereby incorporated by reference.

TECHNICAL FIELD

The present invention is generally directed to an antenna for communicating electromagnetic signals, and relates more particularly to a planar array antenna having patch radiators disposed within a compact volume for increasing RF bandwidth and beamwidth.

BACKGROUND OF THE INVENTION

Antenna designers are often forced to design antennas in a backward fashion. For example, because of the increasing public concern over aesthetics and the "environment" , antenna designers are typically required to build an antenna in accordance with a radome that has been approved by the general public, land owners, government organizations, or neighborhood associations that will reside in close proximity to the antenna. Radomes are typically enclosures that protect antennas from environmental conditions such as rain, sleet, snow, dirt, wind, etc. Requiring antenna designers to build an antenna to fit within a radome as opposed to designing or sizing a radome after an antenna is constructed creates many problems for antenna designers. Stated differently, the antenna designer must build an antenna with enhanced functionality within spatial limits that define an antenna volume within a radome. Such a requirement is counterproductive to antenna design since antenna designers recognize that the size of antennas are typically a function of their operating frequency. Therefore, antenna designers need to develop high performance antennas that must fit within volumes that cut against the ability to size antenna structures relative to their operating frequency.

Conventional antenna systems confined within predefined volumes, such as radomes, usually cannot provide for large beamwidths in addition to large bandwidths. In other words, the conventional art typically requires costly and bulky hardware in order to provide for a wide beamwidths and bandwidths, where beamwidth is measured from the half-power points (−3 dB to −3 dB) of a respective RF beam. Such bulky and costly hardware usually cannot fit within very small, predefined volumes.

Another drawback of the conventional art relates to the manufacturing of an antenna system and the potential for passive intermodulation (PIM) that can result because of the material used in conventional manufacturing techniques. More specifically, with conventional antenna systems, dissimilar materials, ferrous materials, metal-to-metal contacts, and deformed or soldered junctions are used in order to assemble a respective antenna system. Such manufacturing techniques can make an antenna system more susceptible to PIM and therefore, performance of a conventional antenna system can be substantially reduced.

Accordingly, there is a need in the art for a substantially compact antenna system that can fit within a predefined volume and that can generate relatively wide RF radiation patterns and increased RF bandwidth. Further, there is another need in the art for a compact antenna system that can be manufactured with ease and that can utilize manufacturing techniques which substantially reduce passive intermodulation. There is an additional need in the art for a substantially compact antenna system that can handle the power characteristics of conventional antenna systems without degrading the performance of the antenna system.

SUMMARY OF THE INVENTION

The present invention solves the aforementioned problems with an antenna system that can generate large and wide RF radiation fields in addition to providing increased bandwidth. This enhanced functionality can be achieved with a compact antenna system, where the antenna system without a radome can typically have a height of less than one seventh (1/7) of a wavelength and a width that is less than or equal to six-tenths (0.6) of a wavelength. With an antenna radome, the antenna system can have a height that is less than or equal to one-fifth (1/5) of a wavelength. The antenna system can comprise one or more patch radiators separated from each other by an air dielectric and by relatively small spacer elements. The patch radiators can have predefined shapes for increasing beamwidths.

In one exemplary embodiment, the patch radiators can have a substantially rectangular shape. One or more lower patch radiators can be mounted to a printed circuit board that can comprise an RF feed network and a ground plane which defines a plurality of symmetrically, shaped slots. In one exemplary embodiment, the slots can comprise a "dog-bone" or "dumbell" shape that has an electrical path length that is less than or equal to a half wavelength.

The slots within the ground plane of the printed circuit board can be excited by stubs that are part of the feed network of the printed circuit board. The slots, in turn, can establish a transverse magnetic mode of RF radiation in a cavity which is disposed adjacent to the ground plane of the printed circuit board and a ground plane of the antenna system.

The cavity can be concentrically aligned with geometric centers of the patch radiators. The feed network of the printed circuit board can be aligned with portions of the cavity such that the portions of the cavity function as a heat sink for absorbing or receiving thermal energy produced by the feed network. Because of this efficient heat transfer function, the printed circuit board can comprise a relatively thin dielectric material that is typically inexpensive.

The cavity disposed between the printed circuit board and the ground plane of the antenna system can function electrically as a closed boundary when mechanically, the cavity has open corners. The open corner design facilitates ease in manufacturing the cavity. The open corners of the cavity can also have dimensions that permit resonance while substantially reducing Passive Intermodulation (PIM).

PIM can be further reduced by planar fasteners used to attach respective flanges and a planar center of a respective cavity to the ground plane of the printed circuit board and the ground plane of the antenna system. The planar fasteners can comprise a dielectric adhesive. In addition to the dielectric adhesive, the present invention can also employ other types of fasteners that reduce the use of dissimilar materials, ferrous materials, metal to metal contacts, deformed or soldered junctions and other similar materials in order to reduce PIM.

For example, the patch radiators can be spaced apart by plastic fasteners that permanently "snap" into place. Such fasteners not only reduce PIM, but also such fasteners substantially reduce labor and material costs associated with the manufacturing of the antenna system.

In one exemplary embodiment, a radome is placed over the patch radiators. Radomes are typically designed to be electrically transparent to the radiators of a antenna system. However, for the present invention, when a radome is placed over the patch radiators, an unexpected result occurs: the performance of the patch radiators is increased. More specifically, return loss is improved and peak gain is higher relative to an antenna without a radome. Further, upper side lobe suppression is improved compared to an antenna without a radome.

While providing a product that can be manufactured efficiently, the present invention also provides an efficient RF antenna system. The RF energy produced by the cavity, slots, and stubs can then be coupled to one or more patch radiators. The patch radiators can then resonate and propagate RF energy with relatively wide beamwidths and increased bandwidth.

DETAILED DESCRIPTION OF THE PRESENT INVENTION

The antenna of the present invention can solve the aforementioned problems and is useful for wireless communications applications, such as personal communication services (PCS) and cellular mobile radio telephone (CMR) service. The antenna system can include one or more patch radiators, a printed circuit board disposed adjacent to the one or more patch radiators, and plurality of slots disposed within a ground plane of the printed circuit board. The antenna further includes a cavity disposed adjacent to the ground plane of the printed circuit board and a second ground plane disposed adjacent to the cavity. The antenna system radiates RF energy with relatively wide beamwidth and bandwidth.

Figure 1:
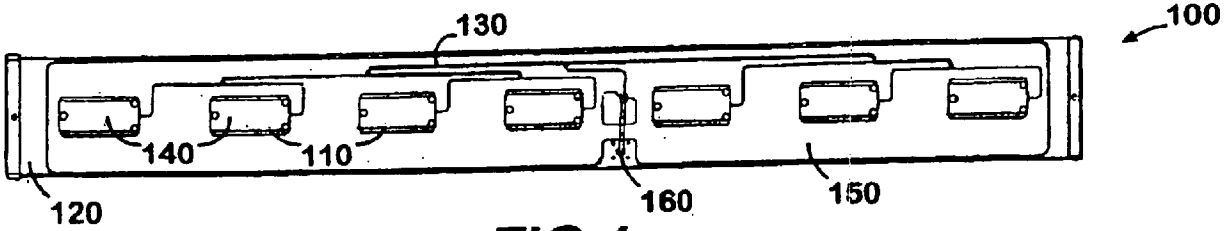
FIG. 1 is an illustration showing an elevational view of the construction of an exemplary embodiment of the present invention.

Turning now to the drawings, in which like reference numerals refer to like elements, FIG. 1 is an illustration showing an elevational view of one exemplary embodiment of the present invention. Referring now to FIG. 1, an antenna system 100 is shown for communicating electromagnetic signals with the high frequency spectrums associated with conventional wireless communication systems. An antenna system 100 can be implemented as a planar array of radiating elements 110, 140 known as wave generators or radiators, wherein the array is positioned along a vertical plane of the antenna as viewed normal to the antenna site.

The antenna system 100, which can transmit and receive electromagnetic signals, includes radiating elements 110, 140, a ground plane 120, and a feed network 130. The antenna system 100 further includes a printed circuit board 150, and a port 160.

Figure 2:
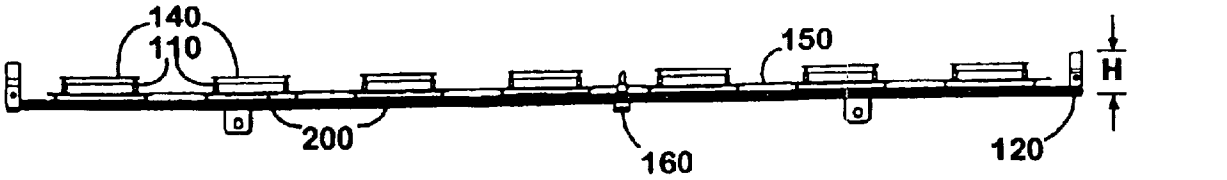
FIG. 2 is an illustration showing a side view of the exemplary embodiment shown in FIG. 1.

Referring now to FIG. 2 which illustrates the side view of the antenna system 100 of FIG. 1, the spatial relationship between a first set of radiating elements 110 and a second set of radiating elements 140 are more clearly shown. The first set of radiating elements 110 are positioned between the second set of radiating elements 140 and the printed circuit board 150. On a side of the printed circuit board 150 opposite to the first set of radiating elements 110 and the second set of radiating elements 140 are a plurality of cavities 200 which will be discussed in further detail below. The port 160 can comprise a coaxial cable type connector.

Figure 3:
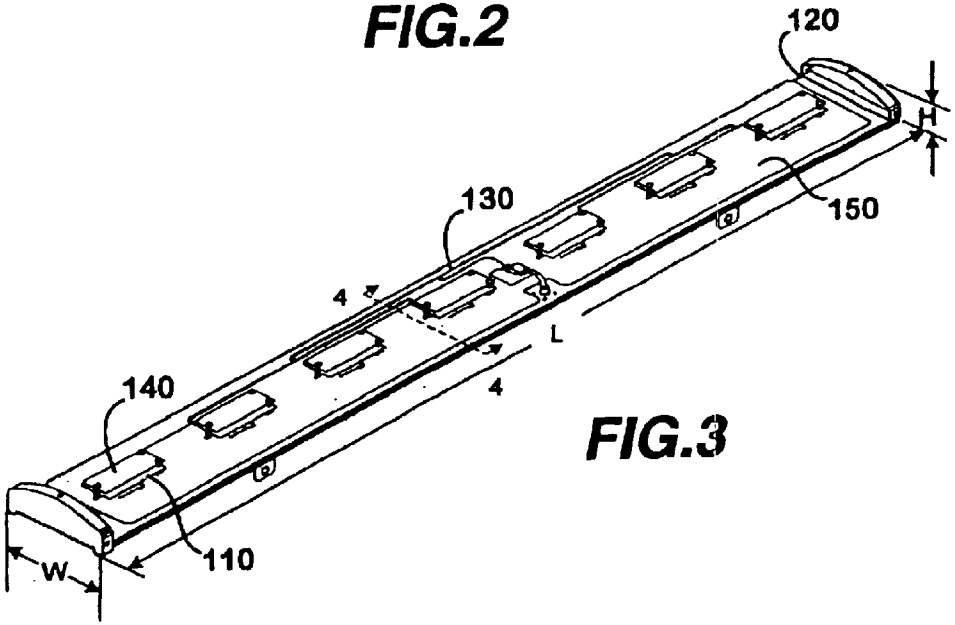
FIG. 3 is an illustration showing an isometric view of the exemplary embodiment shown in FIGS. 1 and 2.

FIG. 3 further illustrates an isometric view of the antenna system 100 which can comprise a plurality of a first set of radiating elements 110 and a second set of radiating elements 140. The antenna system 100 as illustrated in FIG. 3 is very compact yet high performance product that can be placed or positioned in a very narrow or small volume such as a radome. For example, in one exemplary embodiment, the length L can be approximately 72 inches while the width W can be approximately 8 inches. The height H of the antenna system 100 (including a radome) can be 2.75 inches. In this exemplary embodiment the operating frequency range is approximately from 806 MHz to 896 MHz. In terms of wavelength, this means that the width W can be less than or equal to six-tenths (0.6) of a wavelength. Similarly, the height H, without a radome, can be less than or equal to one-seventh (1/7) of a wavelength. The height H, with a radome, can be less than or equal to one-fifth (1/5) of a wavelength. The length L can be varied depending upon the number of radiating elements 110 desired to be in the antenna system 100.

Figure 5:
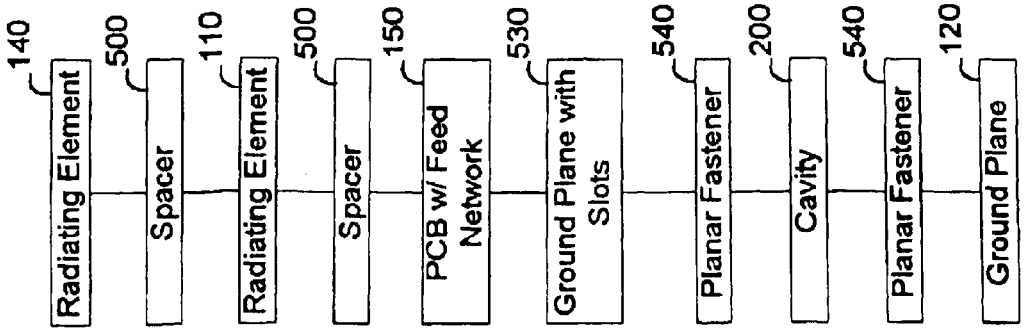
FIG. 5 is a block diagram illustrating some of the core components of the exemplary embodiment illustrated in FIG. 5.
Figure 4:
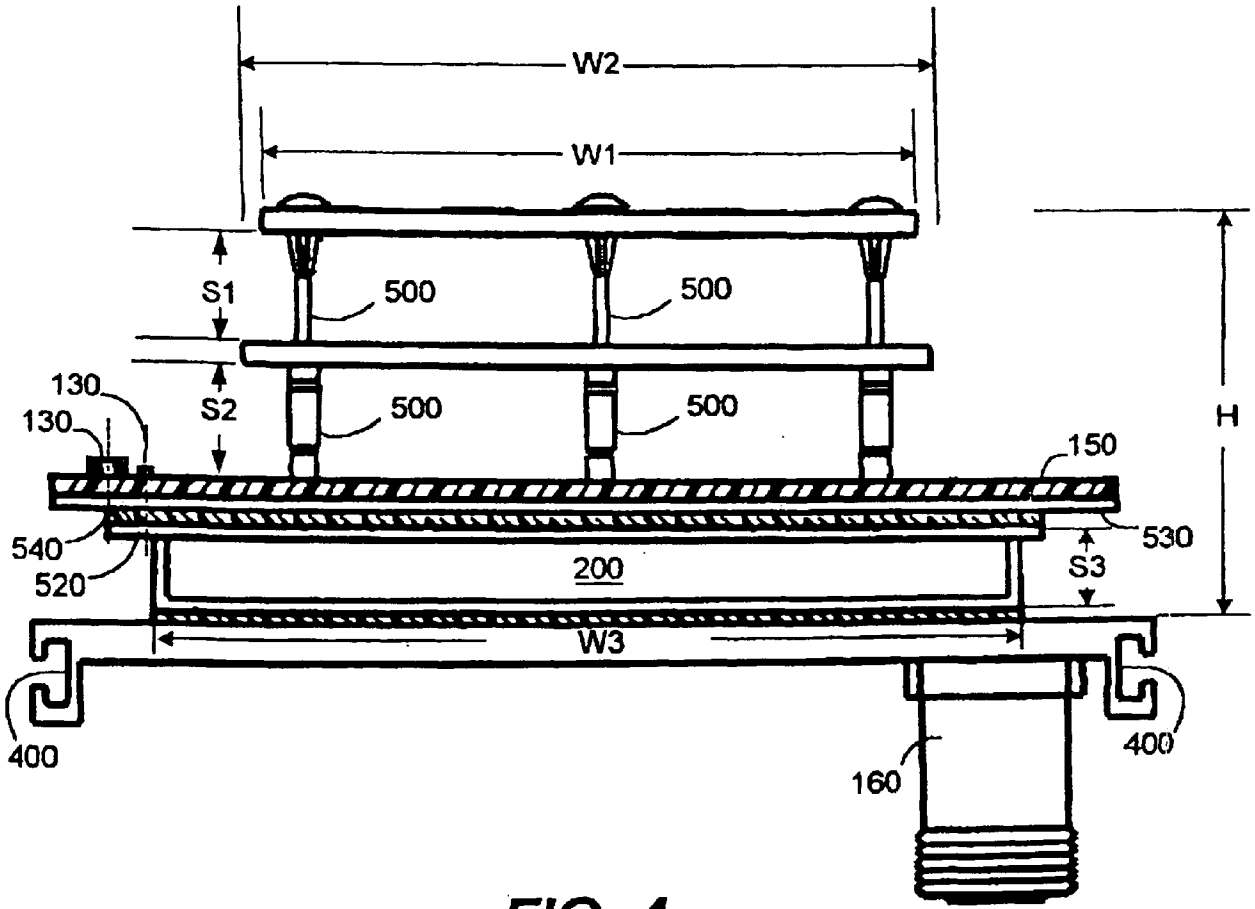
FIG. 4 is a cross-sectional view of the exemplary embodiment illustrated in FIG. 3 taken along the cut line 4—4.

Referring now to FIG. 4, this figure illustrates a cross-section of the antenna system 100 illustrated in FIG. 3. This particular cross-section is taken along the cut line 4—4 as illustrated in FIG. 3. FIG. 4 provides further details of the mechanical elements which form the inventive antenna system 100. The sizes of materials illustrated in FIG. 5 are not shown to scale. In other words, some of the materials have been exaggerated in size so that these materials can be seen easily. A more accurate depiction of the relative sizes of materials will be illustrated below with respect to FIG. 11.

A second radiating element 140 is spaced from a first radiating element 110 by a spacing S1. Spacing S1 is typically a resonant dimension. That is, the parameter S1 size is typically a resonant dimension or a dimension that promotes resonance of the second radiating element 140. The second radiating element 140 in one exemplary embodiment can have a length L1 of 0.364 wavelengths and a width W1 of 0.144 wavelengths. However, the present invention is not limited to these values. Other resonant dimensions are not beyond the scope of the present invention. Further, the present invention is not limited to a plurality of radiating elements 110, 140. A single radiating element can be employed with out departing from the scope and spirit of the invention.

The first radiating antenna element 110 can be spaced from the printed circuit board 150 by a spacing parameter S2 which is also typically a resonant value. In other words, the parameter S2 is one that typically promotes resonance of the radiating patch element 110. In terms of wavelength, the parameter S2 is typically between 0.03 to 0.05 wavelengths (or 0.42 to 0.83 inches at the exemplary operating frequency range). The first radiating element 110 in one exemplary embodiment can have a length L2 of 0.364 wavelengths and a width W2 of 0.224 wavelengths. However, the present invention is not limited to these values. Other resonant dimensions are not beyond the scope of the present invention.

The second radiating element 140 is typically held in place relative to the first radiating element 110 by spacer elements/fasteners 500 which can comprise dielectric standoffs. The first radiating element 110 is similarly positioned from the printed circuit board 150 by a plurality of spacers/fasteners 500. The spacers/fasteners 500 are typically designed to permanently "snap" into place in order to eliminate or reduce the use of soldering points of the present invention. This, in turn, also substantially reduces work in the manufacturing process of the Antenna System 100. Further, by using such spacers/fasteners passive intermodulation (PIM) can also be substantially reduced or eliminated. However, the present invention is not limited to "snap" type fasteners. Other fasteners or dielectric supports that can reduce PIM are not beyond the scope of the present invention. For example, slim or narrow blocks of dielectric foams could be used to support the radiating elements 110, 140.

As illustrated in FIGS. 3 and 4, the second radiating element 140 and the first radiating element 110 typically comprise patch elements. The second radiating element 140 and first radiating element 110 are typically made from conductive materials such as aluminum. Specifically, both elements can be made from aluminum 5052. Similarly, the cavity 200 can also be constructed from aluminum. However, other conductive materials are not beyond the scope of the present invention for the radiating structures. Further, the radiating elements 110, 140 can also be constructed with combinations of materials such as dielectric materials coated with a metal. Those skilled in the art will appreciate the various ways in which radiating elements can be constructed without departing from the scope and spirit of the present invention.

In one preferred exemplary embodiment, both the second radiating element 140 and first radiating element 110 are substantially rectangular in shape. The rectangular shape of the patches 140, 110 in combination with the apertures or slots 700 (as will be discussed below) and resonating cavity 200 increase bandwidth and beamwidth produced by the antenna system 100. However, the present invention is not limited to rectangular shaped patch elements. Other shapes include, but are not limited to, square, circular, and other similar shapes that maximize the beamwidth and bandwidth of a compact antenna system.

The present invention is also not limited to the number of radiating elements 110, 140 within a stacked arrangement or the number of stacked arrangements illustrated in the drawings. Additional or fewer radiating elements 110, 140 of stacked arrangements are not beyond the scope of the present invention. For example, more radiating elements 110, 140 could be employed in respective stacked arrangements in order to increase bandwidth.

FIG. 4 illustrates further details of the antenna system 100 that are not shown in the previous figures. For example, portions of the feed network 130 arc substantially aligned over portions of the cavity 200. By aligning portions of the feed network 130 over portions of the cavity 200, such as flanges 520 (as will be discussed in further detail below) the present invention can dissipate heat energy formed within the feed network 130 more efficiently and rapidly. The flanges 520 can serve as a heat sink to portions of the feed network 130.

By using portions of the resonating 200 cavity as a heat sink, a relatively thin printed circuit board 150 can be used. The cavity 200 can be fastened to the printed circuit board 150 (and more specifically, the ground plane 530 of the printed circuit board 150) by using a planar fastener 540 such as a dielectric adhesive. This planar fastener 540 can then reduce the thermal resistance between the feed network 130 and the flange 520.

The cavity 200 can also be attached to the ground plane 120 with a similar planar fastener 540 such as a dielectric adhesive discussed above. Using such fasteners not only reduces the thermal resistance between the feed network 130 and the cavity, it also substantially reduces passive intermodulation (PIM). With portions of the cavity 200 functioning as a heat sink for the feed network 130 exposed upon a printed circuit board 150, a relatively thin substrate of material can be used as the printed circuit board 150. The cavity 200 is attached to the ground plane 530 of the printed circuit board 150 with a planar fastener 540. Similarly, the cavity 200 is attached to the radome supporting ground plane 120 by a planar fastener 540.

The cavity 200 typically propagates a single transverse magnetic ($TM_{01}$) mode of RF energy for the single polarization supported by the antenna system 100. Since cavity 200 resonates, the height or spacing S3 of the cavity has a resonant dimension of 0.027 wavelengths (or a dimension of 0.375 inches at the exemplary operating frequency). The length L3 and width W3 of the resonant cavity 200 each can have a resonant dimension of 0.433 wavelengths. However, the present invention is not limited to these values. Other resonant dimensions are not beyond the scope of the present invention. While propagating a transverse magnetic mode of RF energy, cavity 200 can also substantially increase the front to back ratio of the antenna system 100. The cavity 200 is excited by a slot 700 as will be discussed in further detail below.

FIG. 5 is a functional block diagram illustrating the various components which make up the compact antenna system 100. This figure highlights one exemplary and preferred arrangement of the components of the antenna system 100. Of the components illustrated in FIG. 6, there are a select few which may be considered the core components of the Antenna System 100 that provide the enhanced functionality in such a compact antenna volume. The core components may be considered as the second radiating element 140, the first radiating element 110, the printed circuit board 150, the ground plane 530 with slots 700, and the cavity 200.

Figures 6, 7:
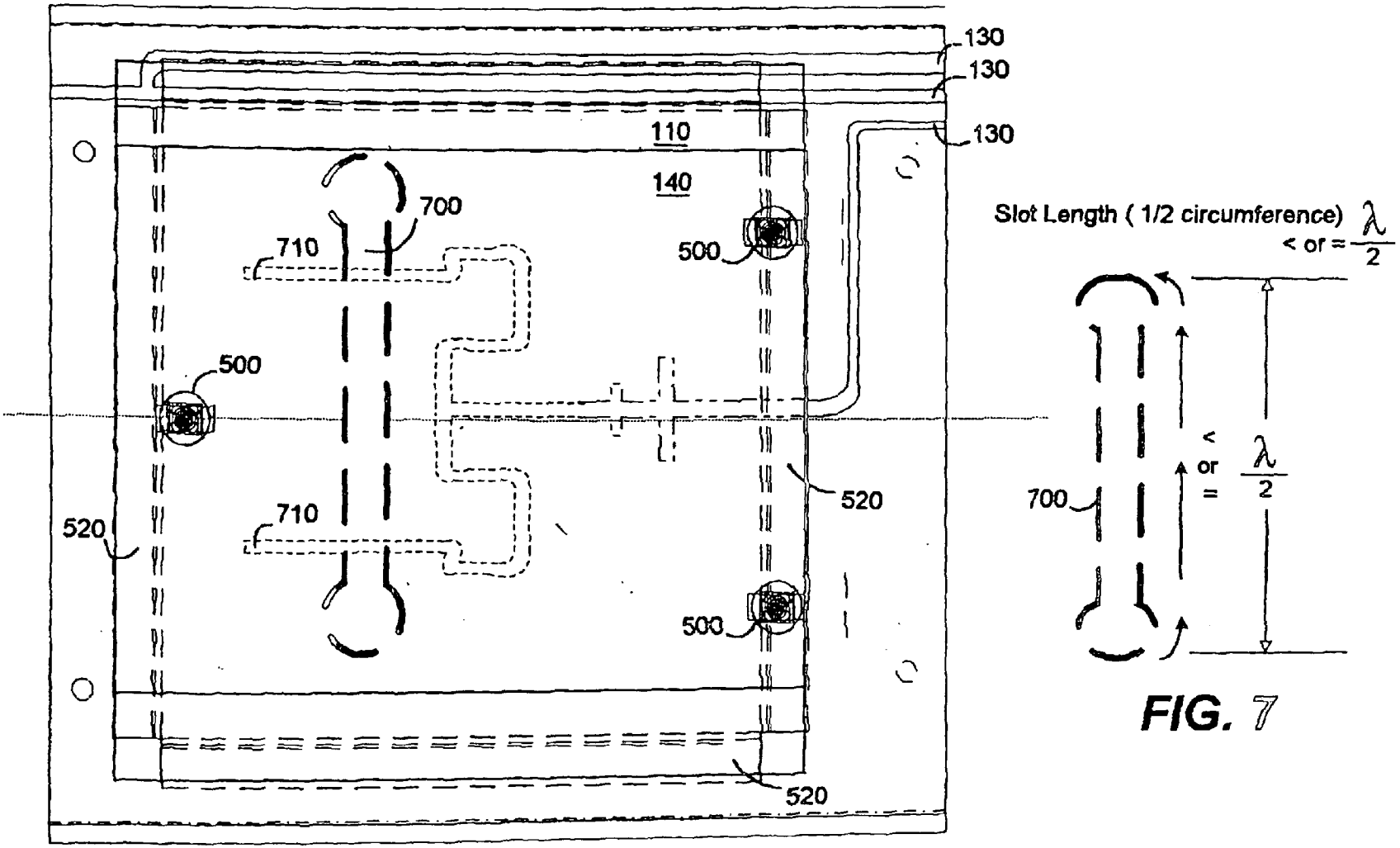
FIG. 6 is an illustration showing an elevational view of the exemplary embodiment illustrated in FIG. 4 while also showing hidden views of the slots which feed the cavity and one or more radiating elements.
FIG. 7 is an illustration showing an exemplary slot according to the present invention.

Referring now to FIG. 6, further details of the slots 700 disposed within the ground plane 530 are shown. The slots 700 are excited by pairs of stubs 710 that are positioned within the feed network 130 disposed on one side of the printed circuit board 150. The spacing and orientation of the slots 700 relative to the first radiating element 110 can optimize the desired transverse magnetic $TM_{01}$ mode of operation within the resonating cavity 200. Optimization of the $TM_{01}$ mode of operation can also be accomplished by using the center of the cavity 200 as the origin for the radiating patches 110, 140. That is, the geometric centers of the patch radiators 110, 140 and cavities 200 can be concentrically aligned.

Referring now to FIG. 7, the slots 700 can also have a predefined shape. For example, in one exemplary embodiment, each slot 700 have a "dogbone" or "dumbell" shape. Typically, this shape comprises two circular regions spaced apart by a relatively long, linear region. However, the present invention is not limited to this shape. Other shapes include, but are not limited to, H-shapes, rectangular shapes, and other shapes that have an electrical length that is less than or equal to one-half the wavelength. The electrical length of a slot is typically found by measuring half of the perimeter of the opening, starting at one far end of the slot to another far end. An electrical length of less than or equal to one-half of a wavelength facilitates efficient coupling of RF energy to the cavity 200 and patch first radiating element 110. Also, the present invention is not limited to a single slot embodiment where two stubs 710 feed a slot. For example, pairs of slots could be matched with pairs of stubs 710. That is, each stub 710 could feed a respective slot 700. Other combinations of slots and stubs are not beyond the scope of the present invention.

Figures 8, 9E:
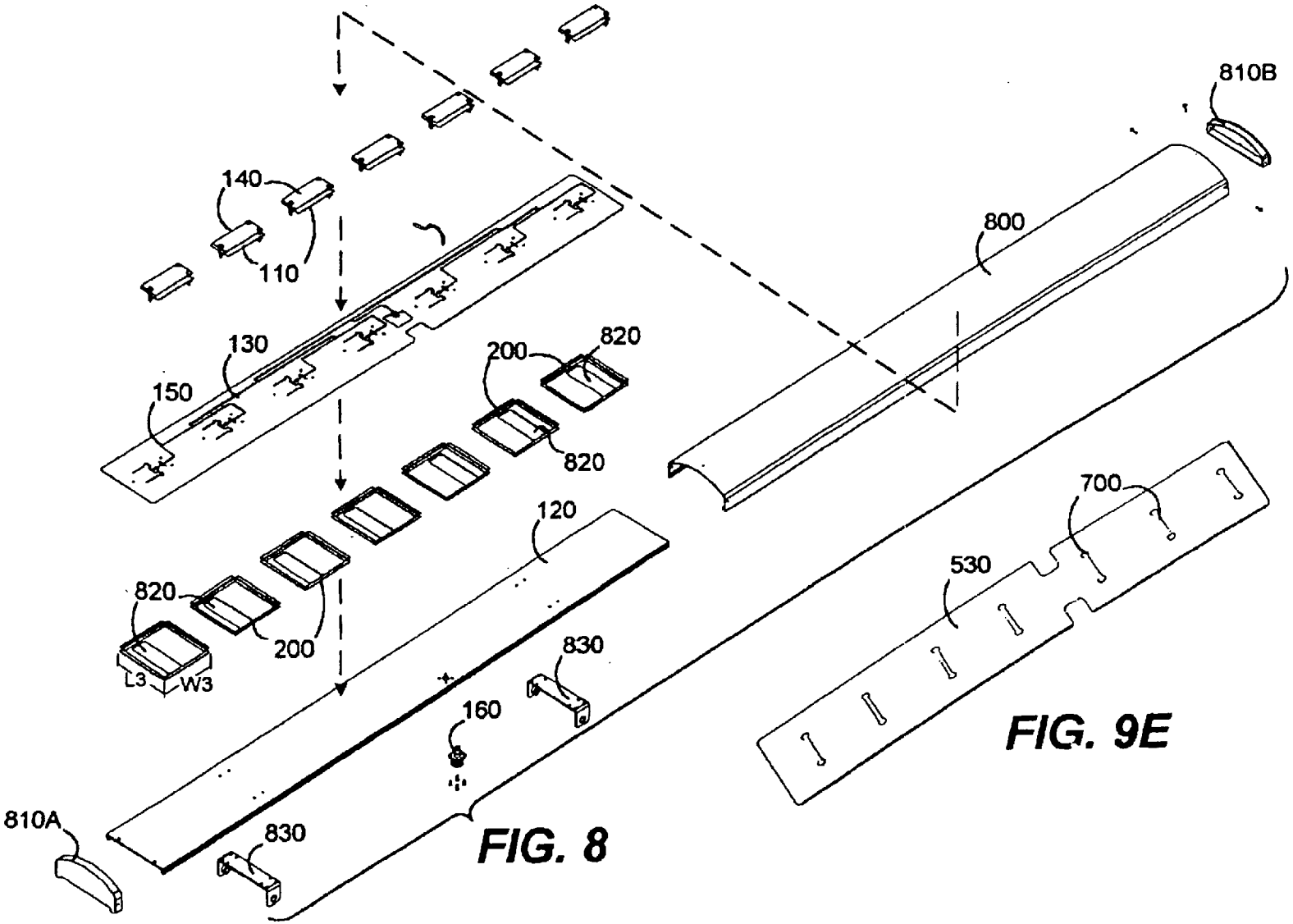
FIG. 8 is an illustration showing an exploded view of an exemplary embodiment of the present invention.
FIG. 9E is an illustration showing a bottom or rear view of a ground plane of the printed circuit board comprising the feed network as illustrated in FIG. 8.

Referring now to FIG. 8, this figure illustrates an exploded view of the components of the antenna system 100. A protective radome 800 comprising a PVC material can be used to cover the antenna system 100. A radome 800 preferably comprises a PVC material manufactured in the desired form by an extrusion process. The radome 800 is attached to the grooves 400 formed in the ground plane 120. A pair of end caps 810A and 810B are positioned along a minor dimension at an end of the ground plane 120 and cover the remaining openings formed at the end of the combination of the ground plane 120 and the radome 800. Encapsulation of the antenna system 100 within the sealed enclosure formed by the ground plane 120, a radome 800, and the end caps 810A–B protects the antenna system 100 from environmental elements, such as direct sunlight, water, dust, dirt and moisture.

In the exemplary embodiment illustrated in FIG. 8, each of the cavities 200 have an aperture 820 disposed in the base portion. This aperture 820 is designed to receive a portion of a mounting bracket 830. However, typically only two mounting brackets 830 are employed for an antenna array. But each cavity 200 may include an aperture 820 to facilitate repeatability in manufacturing and sharing of parts. For those cavities 200 in an array that do not receive the mounting bracket 830, the apertures 820 are electrically and mechanically closed by the ground plane 120. During antenna operation, due to the thickness of a respective cavity 200 and the thickness of a respective planar fastener 540, an aperture 820 not receiving a mounting bracket 830 is virtually electrically transparent.

When radome 800 is positioned over the radiating elements 110, 140, performance of the antenna system 100 is unexpectedly enhanced. In other words, while radomes are usually designed to be transparent and to have little or no effect on RF energy being generated or received by an antenna, radome 800 provides for some unexpected results for the present invention. More specifically, Table 1 illustrates some increased performance in peak gain, upper side lobe suppression, and in return loss when radome 800 is encloses the inventive antenna.

TABLE 1

Enhanced Performance of Antenna with Radome

| | | 806 MHz | 828.5 MHz | 851 MHz | 873.5 MHz | 896 MHz | Average |
|---|---|---|---|---|---|---|---|
| Peak Galn (dBd) | With radome | 11.34 | 11.51 | 11.5 | 11.58 | 11.79 | 11.54 |
| | W/o radome | 11 | 11.49 | 11.45 | 11.26 | 11.53 | 11.34 |
| USS* (dB) | With radome | 20 | 17.5 | 23 | 26 | 25 | 22.3 |
| | W/o radome | 18 | 16 | 11.5 | 22.5 | 20.5 | 17.7 |
| Return Loss (dB) | With radome | −18.1 | −24 | −20.6 | −22 | −20.9 | −21.1 |
| | W/o radome | −14.8 | −20.5 | −17.7 | −17 | −17.9 | −17.6 |

Figure 9A:
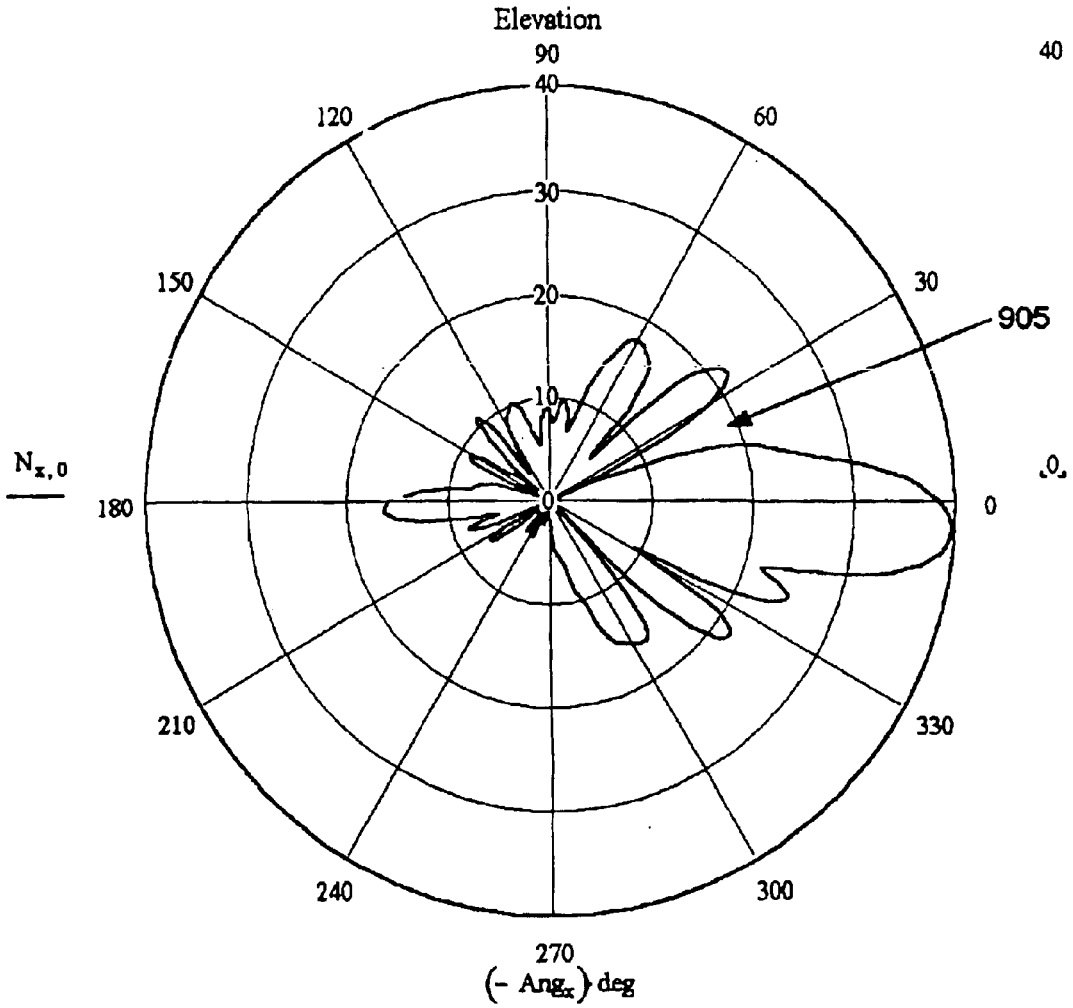
FIG. 9A illustrates an elevation polar radiation pattern for an exemplary embodiment that employs radome.
Figure 9B:
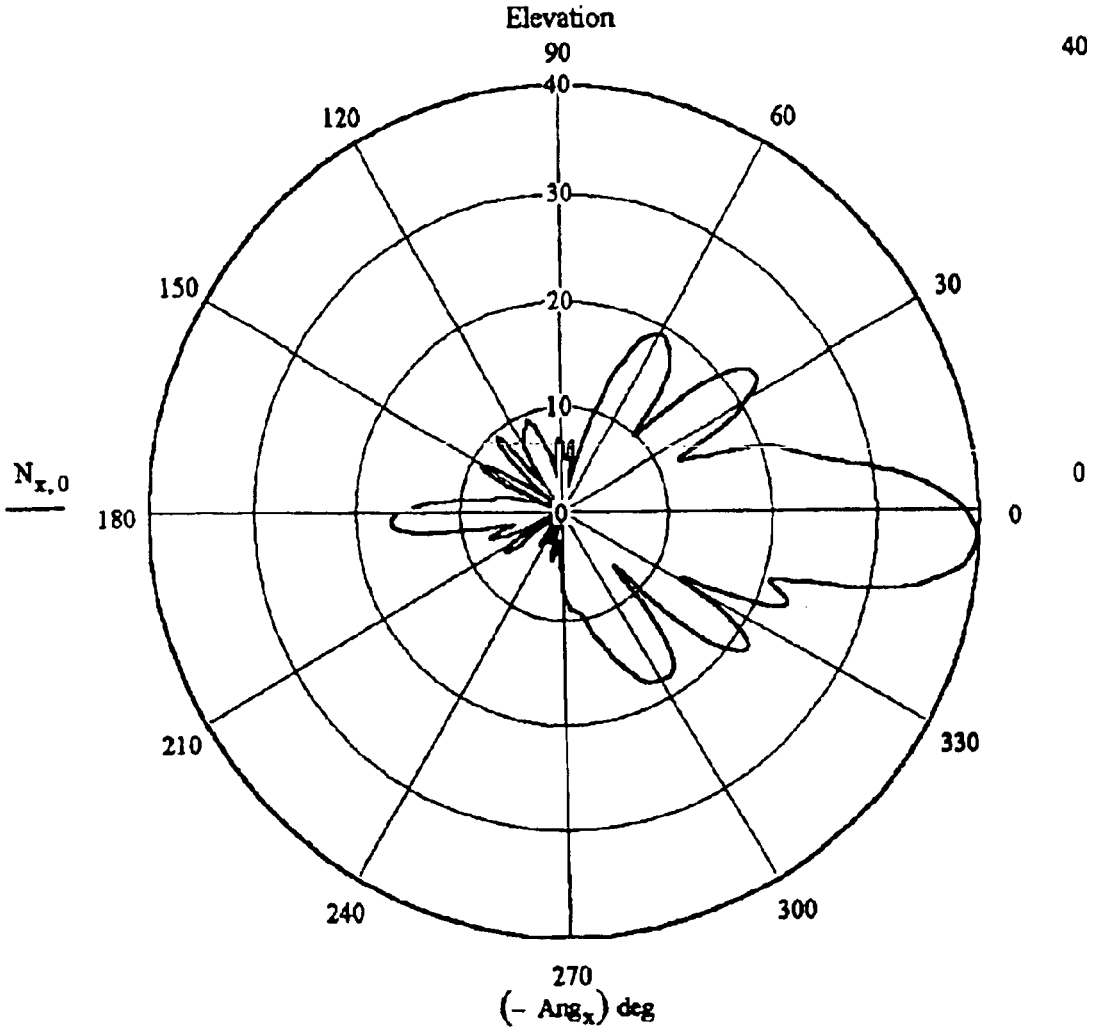
FIG. 9B illlustrates an elevation polar radiation pattern for an exemplary embodiment that does not employ a radome.

FIG. 9A illustrates an elevation polar radiation pattern for an exemplary embodiment that employs radome 800 when the antenna array is aligned in a vertical position. Reference numeral 905 denotes an exemplary region of upper side lobe suppression improvement. FIG. 9B illustrates an elevation polar radiation pattern for an exemplary embodiment that does not employ a radome 800 when the antenna array is aligned in a vertical position.

Figure 9C:
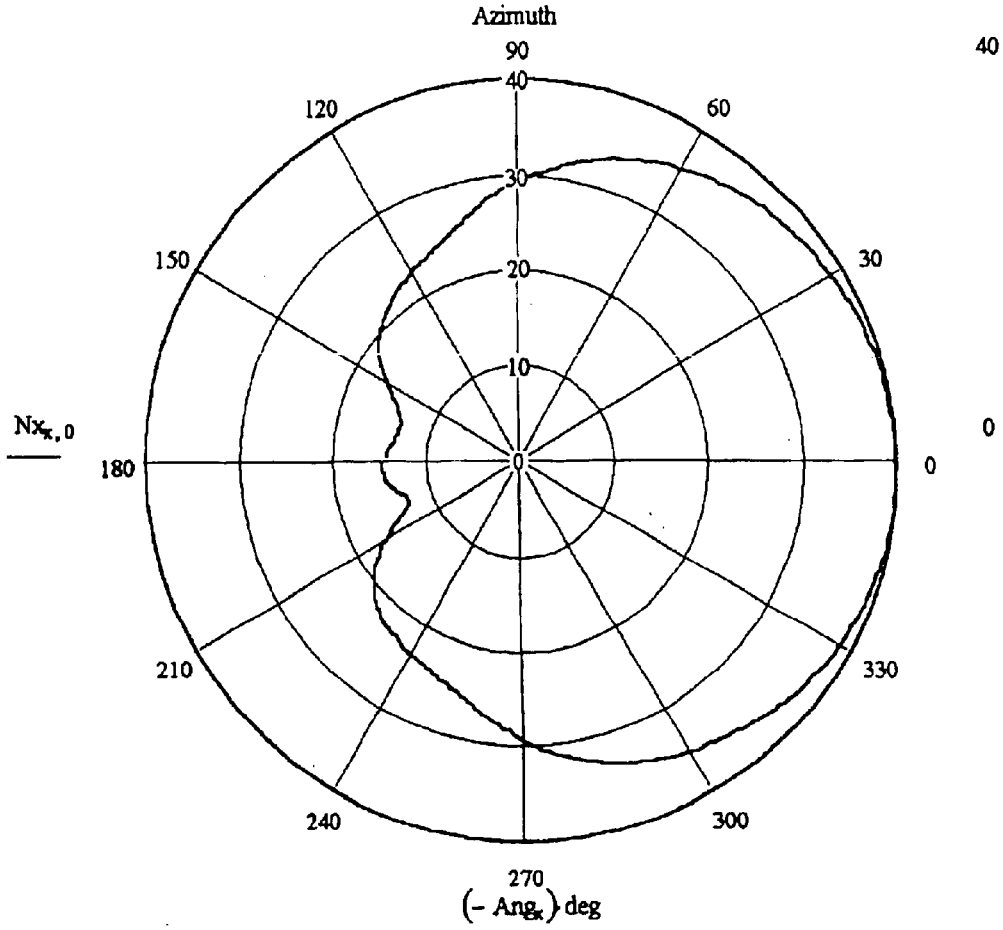
FIG. 9C illustrates an azimuth polar radiation pattern for an exemplary embodiment that employs radome.
Figure 9D:
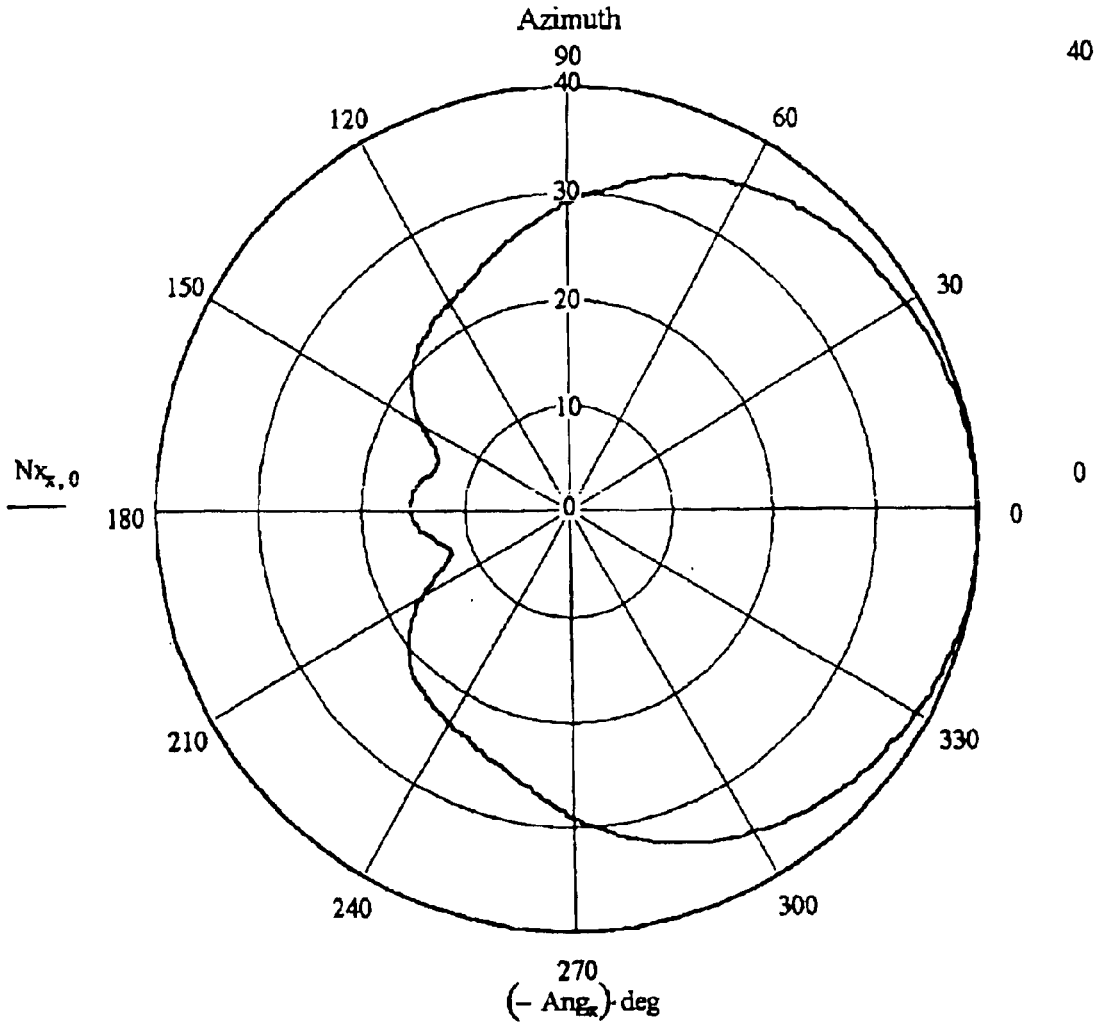
FIG. 9D illlustrates an azimuth polar radiation pattern for an exemplary embodiment that does not employ a radome.

FIG. 9C illustrates an azimuth polar radiation pattern for an exemplary embodiment that employs radome 800 when the antenna array is aligned in a vertical position. FIG. 9D illlustrates an azimuth polar radiation pattern for an exemplary embodiment that does not employ a radome 800 when the antenna array is aligned in a vertical position.

The printed circuit board 150 is a relatively thin sheet of dielectric material and can be one of many low-loss dielectric materials used for the purpose of radio circuitry. In one preferred and exemplary embodiment, the material used has a relative dielectric constant value of $d_k$=3.38 (and $\in_r$=2.7 —when substrate is used as microstrip). In the preferred exemplary environment, TEFLON-based substrate materials are typically not used in order reduce cost. However, TEFLON-based substrate materials and other dielectric materials are not beyond the scope of the Referring now to FIG. 9E, the ground plane 530 contains the slots 700 used to excite the cavity 200. These slots 700 can be preferably etched out of the ground plane 530 by photolithography techniques.

Figure 10A:
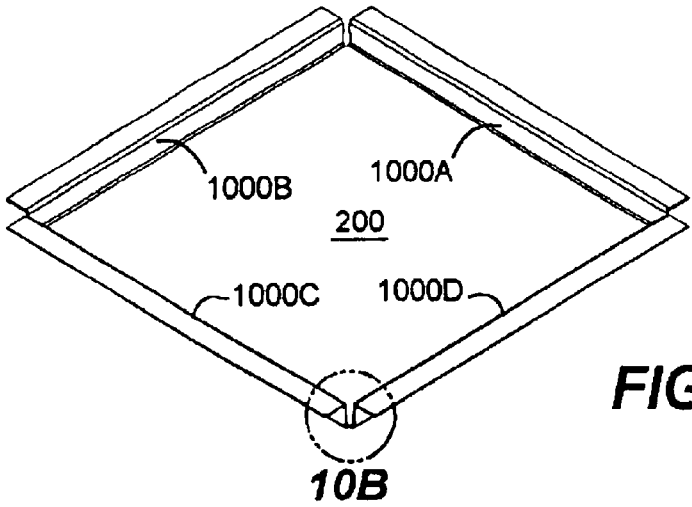
FIG. 10A is an illustration showing an isometric view, of an exemplary resonant cavity for the present invention.

Referring now to FIG. 10A, this figure further illustrates the details of the resonant cavity 200. The cavity 200 is preferably made from aluminum and has a design which promotes accurate repeatability while substantially reducing passive intermodulation (PIM). However, other conductive materials are not beyond the scope of the present invention. The cavity 200 comprises walls 1000A–D that are spaced apart from each other by a predetermined distance d (See FIG. 10B). This predetermined distance d between the walls 1000 at the corners allows for reasonable tolerances in manufacturing, but is typically small enough such that the cavity 200 electrically operates as a closed boundary for RF energy propagating within the cavity 200. In other words, the cavity 200 can function electrically as a closed boundary when mechanically the cavity has open corners. The open corners of the cavity typically have dimensions that permit resonance while substantially reducing passive intermodulation (PIM). The open corners of the cavity also function as drainage holes for any condensation that may form within a respective cavity 200.

Figure 10B:
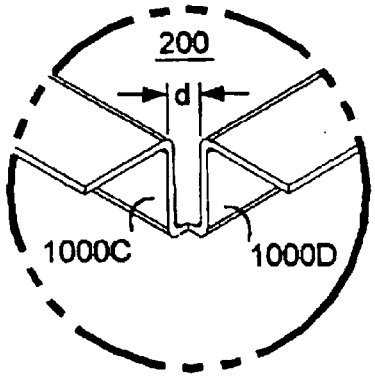
FIG. 10B is an illustration showing an enlarged area focused on an exemplary corner structure of the resonant cavity shown in FIG. 10A.

Referring now to FIG. 10B, a distance d exists between cavity walls 1000C and 1000D. As mentioned above, distance d is sized such that the cavity can resonate while at the same time it can substantially reduce passive intermodulation since there is no metal-to-metal contact between the respective walls 1000C and 1000D. PIM is further reduced by the present invention because dissimilar materials, ferrous materials, metal-to-metal contacts, and deformed or soldered junctions are preferably not used in order to substantially reduce or eliminate this physical phenomenon.

For example, in addition to the open corners of the cavity 200, the present invention employs (as discussed above) planar fasteners 540 to attach the Flanges 520 of the cavity 200 to the ground plane 530 of the printed circuit board 120. Meanwhile, the base of the cavity 200 can be attached to the radome-supporting ground plane 120 by another dielectric planar fastener. Similarly, the first radiating element 110 is supported by non-soldered spacers/fasteners 500, and also supports additional spacers/fasteners 500 to support the second radiating element 140.

Figure 11:
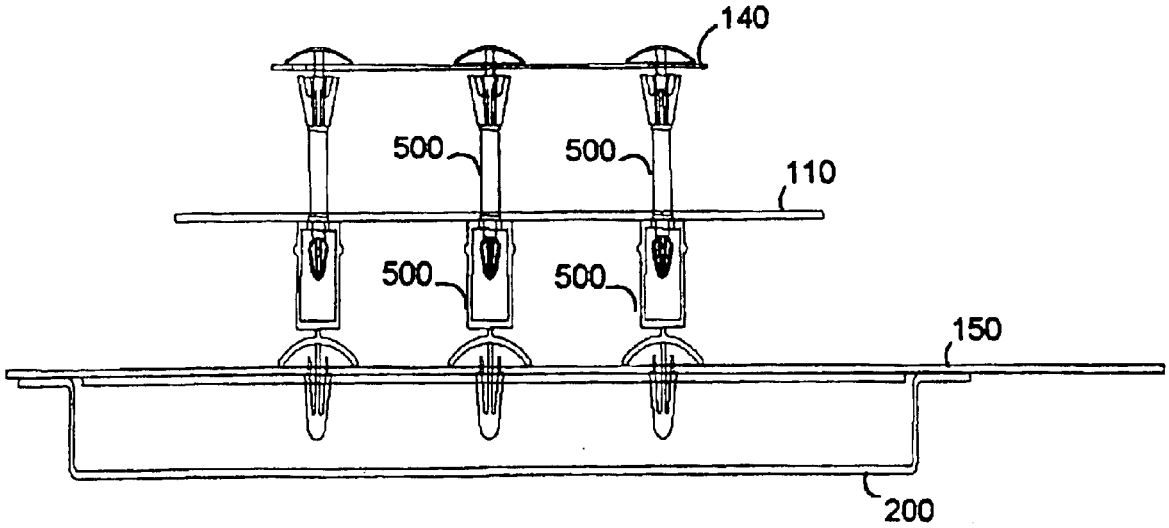
FIG. 11 is an illustration showing a typical mounting arrangement for an antenna provided by an exemplary embodiment of the present invention.

Referring now to FIG. 11, this figure further illustrates a more accurate depiction of the relative sizes (thickness) of materials which make up the antenna system 100. Further mechanical details of the spacers/fasteners 500 are shown. As mentioned previously, these spacers/fasteners are preferably constructed from dielectric materials to reduce (PIM) while also permitting ease of manufacturing of the antenna system 100. That is, the spacers/fasteners 500 can be permanently "snapped" into place without the use of any deformed or soldered junctions.

Figure 12:
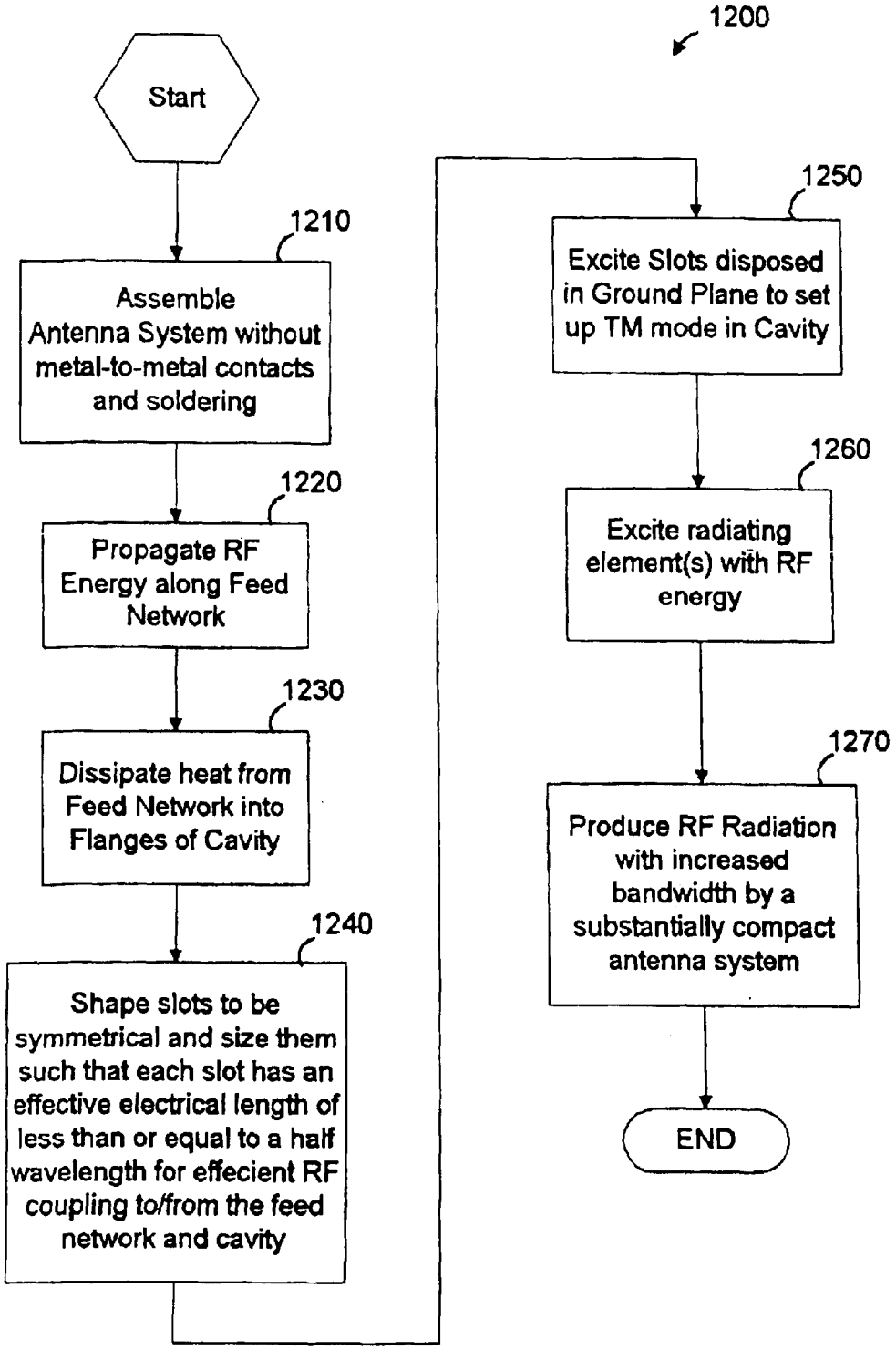
FIG. 12 is an exemplary logical flow diagram highlighting exemplary steps of a method for increasing RF beamwidth and bandwidth in a compact volume.

FIG. 12 illustrates a logical flow diagram 1200 for a method increasing RF bandwidth and beamwidth within a compact volume. The logical flow diagram 1200 highlights some key functions of the antenna system 100.

Step 1210 is the first step of the inventive process 1200 in which the antenna system 100 is assembled without metal-to-metal contacts and soldering. More specifically, in this step, the antenna system 100 can be manufactured in a way to substantially reduce passive intermodulation (PIM). Dissimilar materials, ferrous materials, metal-to-metal contacts, and deformed or soldered junctions are typically not employed or are limited in the antenna system 100 in order to substantially reduce or eliminate PIM. One way in which PIM is substantially reduced or eliminated is the use of dielectric planar fasteners 540 in order to connect portions of the cavity 200 to the slotted ground plane 530 and the ground plane 120. Another way in which PIM is reduced or substantially eliminated is by employing open corners in the cavity 200 where respective walls, such as walls 1000C and 1000D of FIG. 10B, are spaced apart by the predetermined distanced.

Next, in step 1220 RF energy is propagated along the feed network 130 of the printed circuit board 150. In step 1230, heat is dissipated from the feed network 130 into flanges 520 of the cavity 200.

In step 1240, the slots 700 are symmetrically shaped and sized such that each slot has an effective electrical length of less than or equal to a half wavelength. Such shape and size of the slots 700 promotes efficient RF coupling between the slots 700 and the stubs 710 and between the slots 700 and the resonant cavities 200.

In step 1250, the slots 700 disposed in ground plane 530 set up or establish a transverse magnetic (TM) mode of RF energy in the cavity 200. Next, in step 1260, the radiating elements such as the first and second patch radiators 110, 140 are excited with RF energy emitted from the slot 700 or the stubs 710 or both. Next, in step 1270, RF radiation is produced with increased RF beamwidth and bandwidth.

The present invention provides cavity-backed, aperture or slot coupled patch elements that produce RF energy with increased beamwidths and bandwidths. The present invention also provides a compact antenna system that has a height (without a radome) of less than one seventh (1/7) of a wavelength and a width that is less than or equal to six-tenths (0.6) of a wavelength. With a radome, the height can be one-fifth (1/5) of a wavelength. While being compact, the present invention is power efficient. The present invention incorporates an efficient heat transfer design such that a feed network transfers its heat to a resonating cavity used to set up desired transverse magnetic modes of RF energy. The efficient heat transfer permits the present invention to utilize relatively thin dielectric materials for the printed circuit board supporting the feed network.

The present invention further incorporates a low PIM design approach by utilizing capacitive coupling of all potential metal-to-metal junctions through employing non-conductive planar fasteners and open corners for the resonant cavity 200. The low PIM design approach also yields efficient and low cost manufacturing methods. For example, the planar fasteners 540 eliminate any need for soldering the resonant cavity 200 to the ground plane 530. The use of dielectric spacers 500 further eliminates any need for costly dielectric spacer sheets while also reducing assembly time.

The radome 800 yields some unexpected results for the present invention. While designed to be electrically transparent to the radiating elements 110, 140, the radome 800 actually increases the performance of the antenna system 100.

Alternative embodiments will become apparent to those skilled in the art to which the present invention pertains without departing from its spirit and scope. Thus, although this invention has been described in exemplary form with a certain degree of particularity, it should be understood that the present disclosure has been made only by way of example and that numerous changes in the details of construction and the combination and arrangement of parts may be resorted to without departing from the spirit and scope of the invention. Accordingly, the scope of the present invention is defined by the appended claims rather than the foregoing description.

What is claimed is:

1. An antenna array comprising:

a plurality of stacked radiating elements, each stacked radiating element comprising a first rectangular patch radiator and a second rectangular patch radiator;

a printed circuit board disposed adjacent to each said fist rectangular patch radiator, said printed circuit board comprising a plurality of stubs and a ground plane; said first rectangular patch radiator disposed between said second rectangular patch radiator and said printed circuit board;

a plurality of slots positioned within said ground plane, each slot being aligned with a respective stacked radiating element; and a plurality of cavities enclosing said ground plane and respective slots whereby said stubs feed said slots and said slots excite respective cavities such that said patch radiators radiate RF energy with increased beamwidth and bandwidth.

2. The antenna array of claim 1, wherein said first patch is spaced apart from said second patch by one or more dielectric spacer elements.

3. The antenna array of claim 1, wherein each of said slots has an electrical length that is less than or equal to one half of wavelength.

4. The antenna array of claim 1, wherein each of said slots comprises a dogbone shape.

5. The antenna array of claim 1, wherein said slots establish a transverse-magnetic mode of RF energy within said cavity.

6. The antenna array of claim 1, where each cavity has two or more walls that form corners, each corner comprising a predetermined spacing to substantially reduce or eliminate passive intermodulation.

7. An antenna array comprising:

a plurality of stacked radiating elements, each stacked radiating element comprising a first radiator and a second radiator;

a printed circuit board disposed adjacent to said first radiator, said printed circuit board comprising a plurality of stubs and a ground plane, said first radiator being disposed between said second radiator and said printed circuit board;

a plurality of slots positioned within said ground plane, each slot being associated with a respective stacked radiating element;

a plurality of cavities adjacent to said ground plane and respective slots whereby said stubs feed said slots and said slots excite respective cavities such that said radiators radiate RF energy with increased beamwidth and bandwidth; and a radome positioned over the plurality of stacked radiating elements, said radome improving the performance of the antenna array.

8. The antenna array of claim 7, wherein each cavity has two or more walls that form corners, each corner comprising a predetermined spacing to substantially reduce or eliminate passive intermodulation.

9. The antenna array of claim 8, wherein at least one predetermined spacing comprises a dielectric.

10. The antenna array of claim 9, wherein the dielectric comprises air.

11. The antenna array of claim 7, wherein said radome produces an average increase in antenna array peak gain, measured in dBd at five equally spaced frequencies from approximately 806 MHz to 896 MHz of up to approximately 1.7% relative to a peak gain of said antenna array operating without said radome.

12. The antenna array of claim 7, wherein said radome produces an average increase in upper side lobe suppression, measured in dB at five equally spaced frequencies from approximately 806 MHz to 896 MHz of up to approximately 25% relative to upper side lobe suppression of said antenna array operating without said radome.

13. The antenna array of claim 7, wherein said radome produces an average increase in return loss, measured in −dB at five equally spaced frequencies from approximately 806 MHz to 896 MHz of up to approximately 19% relative to a return loss of said antenna array operating without said radome.

14. A method for improving the performance of an antenna array comprising a plurality of stacked radiating elements comprising the steps of:

positioning a plurality of slots within a ground plane of a printed circuit board;

propagating RF energy along a feed network;

dissipating heat from the feed network into portions of a metallic cavity;

exciting the slots to establish a mode of RF energy within the metallic cavity;

exciting patch radiators with the RF energy produced by the slots and the cavity; and improving performance of the antenna array by protecting the antenna array with a radome.

15. The method of claim 14, wherein the step of improving the performance of the antenna array by protecting the antenna array with a radome comprises increasing the average peak gain of the antenna array measured in dBd at five equally spaced frequencies from approximately 806 MHz to 896 MHz of up to approximately 1.7% relative to a peak gain of the antenna array operating without said radome.

16. The method of claim 14, wherein the step of improving the performance of the antenna array by protecting the antenna array with a radome comprises increasing the average upper side lobe suppression, measured in dB at five equally spaced frequencies from approximately 806 MHz to 896 MHz, of up to approximately 25% relative to upper side lobe suppression of the antenna array operating without said radome.

17. The method of claim 14, wherein the step of improving the performance of the antenna array by protecting the antenna array with a radome comprises increasing the average return loss, measured in −dB at five equally spaced frequencies from approximately 806 MHz to 896 MHz, of up to approximately 19% relative to a return loss of the antenna array operating without said radome.

* * * * *